United States Patent [19]

Poore

[11] 4,306,323

[45] Dec. 22, 1981

[54] TOOL FOR REMOVING GLAZING

[76] Inventor: John R. Poore, 24 Bay View Dr., Portland, Me. 04103

[21] Appl. No.: 872,477

[22] Filed: Jan. 26, 1978

Related U.S. Application Data

[63] Continuation-in-part of Ser. No. 584,059, Jun. 5, 1975, abandoned, which is a continuation-in-part of Ser. No. 414,206, Nov. 9, 1973, abandoned.

[51] Int. Cl.[3] ..... E04F 21/28

[52] U.S. Cl. ..... 7/105; 30/279 R; 30/280; 30/340

[58] Field of Search ..... 7/105; 30/340, 279 R, 30/280; 81/177 R; 223/102, 104, DIG. 4; 294/26, 61

[56] References Cited

U.S. PATENT DOCUMENTS

| | | | |
|---|---|---|---|
| 948,861 | 2/1910 | Kailey | 30/299 |
| 1,319,484 | 10/1919 | Nichols | 30/317 |
| 1,519,228 | 12/1924 | Weber | 30/317 |
| 1,586,906 | 6/1926 | Lewis | 30/332 X |
| 2,083,123 | 6/1937 | Quick | 30/315 |
| 2,545,379 | 3/1951 | Pomichter | 30/172 |
| 2,674,005 | 4/1954 | Simon | 30/123 |
| 2,680,255 | 6/1954 | Potter | 7/114 |
| 2,681,756 | 6/1954 | Warmbrodt | 81/3.48 |
| 3,091,852 | 6/1963 | Larber | 30/172 |
| 3,688,401 | 9/1972 | Hartman | 30/172 |
| 3,955,302 | 5/1976 | Tudisco | 294/26 |

*Primary Examiner*—Roscoe V. Parker

[57] ABSTRACT

A tool for use in removing glazing has a head including a conical point of substantial length and a shank connected to a straight handle with the point disposed towards but angled away from the handle at an angle that does not exceed 30°. The maximum diameter of the point is substantially less than the cross section of the glazing and the angle of taper of the point is such that the point may be drawn with moderate pulling forces lengthwise through the glazing with radial expanding stresses resulting that are adequate to rupture the glazing.

11 Claims, 6 Drawing Figures

TOOL FOR REMOVING GLAZING

The present application is a Continuation-in-part of Ser. No. 584,059, filed June 5, 1975, and now abandoned, which was a continuation-in-part of Ser. No. 414,206, filed Nov. 9, 1973 and now abandoned.

BACKGROUND REFERENCES

U.S. Pat. Nos. 948,861, 1,319,484, 1,519,228, 2,083,123, 2,545,379, 2,674,005, 2,680,255, 2,681,756, 3,091,852, 3,688,401.

BACKGROUND OF THE INVENTION

The removal of glazing from the pane-receiving seats of window frames is usually a slow and often a difficult process. Many attempts have been made to provide tools that would enable glazing to be removed more easily and quickly and such proposals include planing and milling tools of various types.

As far as I am aware, none of the proposals has been made available and the removal of glazing is still commonly effected by means of a chisel or other tool by which the glazing can be broken free from the pane-receiving seat, sometimes with a heater first used to soften the glazing.

THE PRESENT INVENTION

The general objective of the present invention is to provide a tool that enables even the hardest glazing to be removed more easily than has previously been possible.

In accordance with the invention this objective is attained by providing a head that includes a relatively long conical steel point, the maximum diameter of which is substantially less than the cross section of the glazing, and a shank connected to a handle with the point disposed towards but angled away from the handle to provide an angular relationship that does not exceed 30° between the point and the line of force generated when the holder is manually held and pulled lengthwise of the glazing with the point entered therein parallel to and close to at least one wall of the pane-receiving seat.

The point is of circular section and is a close approximation of a cone such that with a moderate pulling force employed to pull the point into and through the glazing, stresses result therein adequate to rupture it. The maximum diameter of the point does not exceed 0.250 of an inch and the length of the point does not exceed two inches. The angle of taper of the point is within the 1°–7° range and effects an average stress of at least 600 lbs. p.s.i. The rupturing force is a function of the length of the point and the angle of taper as measured from its extremity to its maximum diameter.

Another objective of the invention is to provide means enabling residual glazing to be removed utilizing the tool, an objective attained with two blades defining an angle of 90° and secured to the handle at the end to which the shank of the head is anchored but on the handle side opposite thereto with the apex of the blades in a plane inclusive of the point and defining an angle of less than 30° relative to the line of force generated when the tool is pulled lengthwise of the seat. The blades are spaced from the handle and their leading edges are planing and scraping edges.

Other objectives of the invention will be apparent from the following description and claims.

BRIEF DESCRIPTION OF THE DRAWINGS

The accompanying drawings illustrate a preferred embodiment of the invention

THE PREFERRED EMBODIMENT OF THE INVENTION

Figure 1:
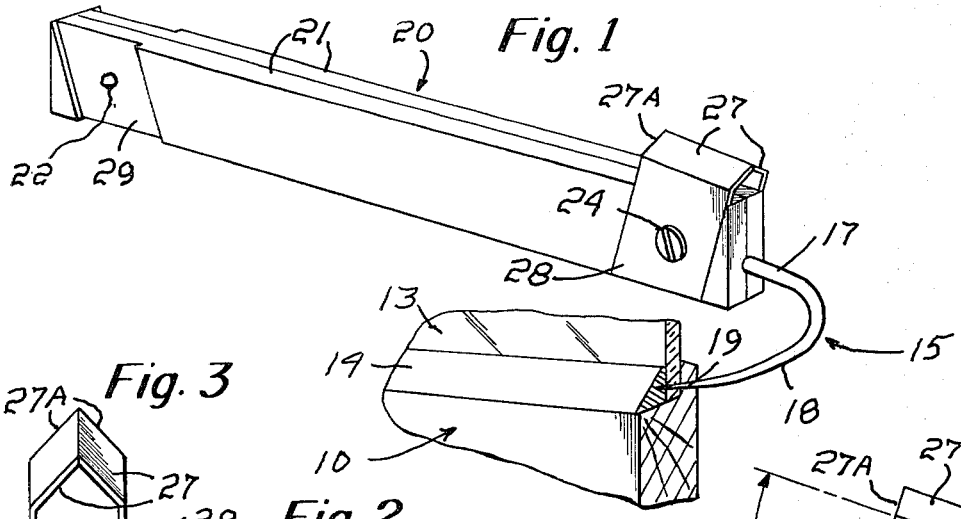
FIG. 1 is a perspective view of the tool positioned for use.
Figure 3:
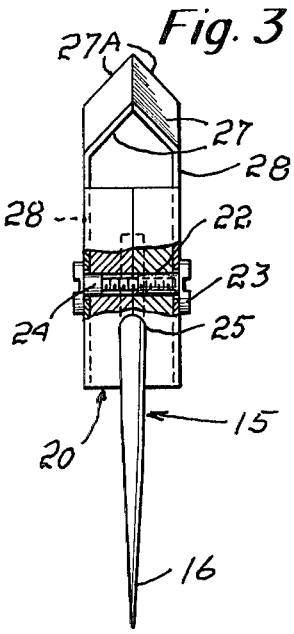
FIG. 3 is a partially sectioned view on an increase in scale taken approximately along the indicated line 3—3 of FIG. 2.
Figure 2:
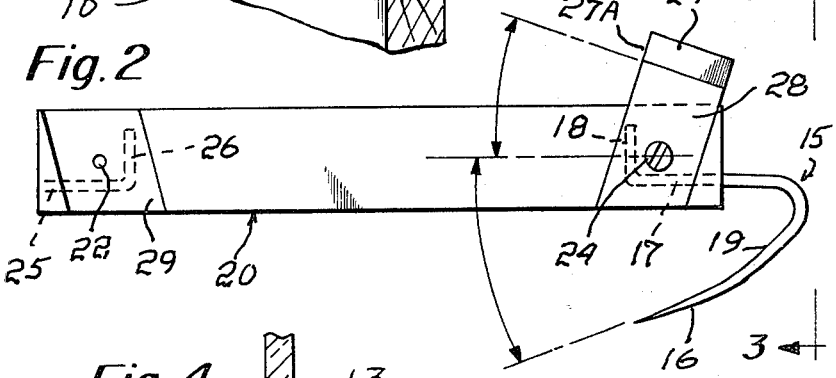
FIG. 2 is a side elevation of the tool.
Figure 4:
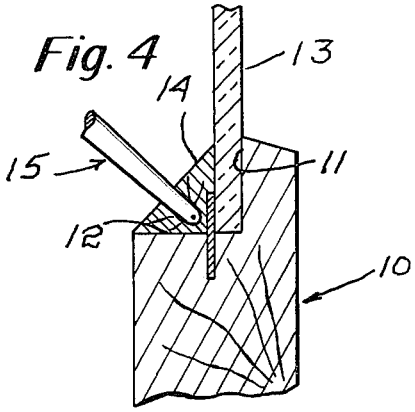
FIG. 4 is a view illustrating the rupturing of the glazing by the conical point as it is pulled lengthwise of the glazing.

While the construction of pane-receiving window frames and the manner in which panes are secured thereto are well known, a section through one of the four sides of a window frame generally indicated at 10 is shown. Such a frame typically includes a pane-receiving seat established by walls 11 and 12 disposed at right angles to each other. The glass pane 13 is dimensioned to fit freely within the rectangular space established by the four walls 11 and rest on the walls 12 which are usually precoated. The glass is held by glazier points, not shown, driven into the wall 11 and glazing 14 then pressed in place to fill the generally triangular space defined by the walls 11 and 12 and a plane inclusive of their margins.

As is well known, the glazing 14 hardens and remains effective for a long time with its useful life depending to a large extent on its exposure to sunlight. When the glazing has deteriorated or if the pane is broken, the existing glazing must be removed and replaced. In some instances, glazing is easily removed but it is often cement-like at least in places and, when the pane is intact, the removal of such glazing is particularly difficult.

The glazing removing tool illustrated by the drawings includes a head, generally indicated at 15 of steel stock and having a relatively long conical point 16, a shank 17 terminating in a right angular anchoring end 18 and an intermediate bend 19 establishing a shank-to-point angular relationship that does not exceed 30° and in practice is approximately 24°.

The maximum diameter of the point 16 is within the 0.025 to 0.250 inch range, the angle of taper is within the 1° to 7° range, and the length of the point, which is dependent on the maximum diameter and angle of taper does not exceed two inches. In practice, the maximum diameter is 0.100 inches and the angle of taper preferably 4° providing a point length of about one inch.

A handle, generally indicated at 20, is shown as consisting of two identical sections 21 having holes 22 adjacent each of their ends to receive male and female shoulder bolts 23 and 24, respectively, by which the two sections are held clamped together. The faces of the sections that are to be in mutual contact have at each of their ends L-shaped channels each including a part 25 extending inwardly from the proximate end below the adjacent hole 22 to accommodate the major portion of the shank 17 and a part 26 to accommodate the anchoring end 18, the channels of a radius such that when one section 21 is reversed relative to the other and the two sections clamped together with the shank 17 and its end 18 held in the now registering L-shaped channels lengthwise and turning movement of the head relative to the handle during use of the tool is prevented.

In the use of the tool, as thus far described, the point 16 is entered into the glazing 14 as close to the wall 11 and the glass 13 as is possible with its long axis parallel thereto and pulled by the handle lengthwise of the glazing towards the user with the glazing rupturing due to expansion forces.

The average stress which the point 16 applies to the glazing 14 during use of the tool is the effective property for causing its rupture. This stress is related to the pulling force on the tool times a factor incorporating the working length of the conical point 16 and the angle of taper of the point, i.e., the angle of the cone. If the angle of taper is small, the average stress is much larger than it would be if the angle of taper were large, as will be apparent from the following table illustrating the relationship of average stress to different angles of taper of the point with a given pulling force of ten pounds.

With the following increases in half angles, resulting substantial reduction in average stress results:

| L/2 | P |
|---|---|
| 3° | 1180 |
| 4° | 650 |
| 6° | 290 |
| 8° | 165 |
| 10° | 105 |

The critical nature of the angle of taper is illustrated by the fact that a ten pound pulling force on the tool produces an average stress applied to the glazing of 2600 lb/in.$^2$ when using a 2° half-angle or a 4° angle of taper with a one-inch working length for the conical point 16. Assuming the same working lengths and a half-angle of 10°, which would be a taper of 20°, the average stress is only 105 lb/in.$^2$. To bring the average stress up to the former value of 2600 lb/in.$^2$ while using the larger angle of taper would require a pulling force of 250 lb. Thus it can be seen that a small angle of taper makes the tool significantly easier and safer to use and more effective than would be the case with a large angle of taper. In addition, a small angle of taper will cause the tool to lift the glazing, rather than drag it forward in the direction of the work. Both of these effects—a smaller pulling force for a given average stress and the lifting rather than the dragging of the glazing—improve the effectiveness of the tool for its designed operation.

A change of the angle of taper without a change in the length of the point results in an increase in diameter of the stock. A change in the angle of taper with stock of the same diameter results in a decrease in the length of the point. In either case, it is apparent that the angle of taper is indeed critical.

Figure 6:
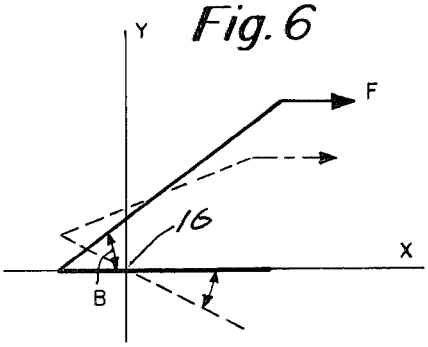
FIG. 6 is a schematic view showing the relation of the angle between the tool pulling line of force and the point of the tool.
Figure 5:
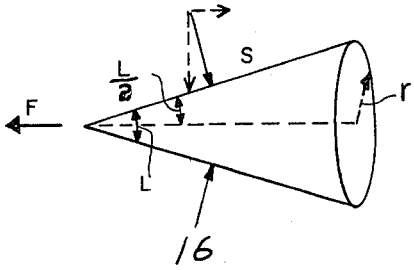
FIG. 5 is a schematic view of the conical point.

The offset angle of the handle 20 relative to the point 16 is also important to the stable and satisfactory operation of the tool. Reference is made to FIG. 6, where the tool point 16 is indicated as the origin and the pulling force is in the positive-x direction. Any momentary deflection of the tool pivoting on its point about the y axis will give rise to a torque tending to cause rotation about the same axis. As long as the offset angle B is such that the handle 20 stays forward of the extremity of the point 16 (i.e., on the positive-x side of the origin), the direction of rotation will be back toward the correct working position, and the tool will be stable in its operation. As the angle B increases, the stability gradually decreases until, when the handle remains entirely on the negative-x side of the origin, the pull becomes a push and the operation of the tool becomes unstable. In this situation, a slight rotation about the y axis now gives rise to a torque which will tend to cause rotation away from the normal working position of the tool, most likely causing the tool to gouge or slip. Thus the offset angle should be as small as possible, without permitting the hand of the user to engage the frame, in order to give maximum stability to the tool's operation.

As usually some glazing adheres to the wood, it is desirable to provide the tool with means enabling residual glazing to be removed. To that end, two blades 27 defining an angle of 90° are secured to the handle 20 at the end in which the shank 17 is anchored but on the handle side opposite the point 16 but with the apex of the blades in the plane inclusive of the point and defining an acute angle with the handle less than 30°, in practice 20°. The blades 27 are spaced from the handle 20 with their leading edges 27A planing or scraping edges.

In practice, the blades 27 are separate with each the angularly disposed end portion of a steel plate 28. The faces of the handle sections 21 that are to be outer surfaces of the handle 20 have shallow channels 29 at each end centrally through which the bolt holes 22 open to enable the plates to be secured by the bolts used to clamp the sections 21 together. The channels 29 are of a width accommodating the plates 28 and are angularly disposed to provide the wanted angle between the blades and the handle. The outer edge of each channel 29 is shown as interconnecting a corner of the handle section 21 of which it is a feature.

In the use of the tool to remove residual glazing, the tool is held with either one or both blades in a position to scrape or plane a wall of the pane-receiving seat and then drawn towards the user.

I claim:

1. A tool for use in removing glazing from a pane-receiving seat having each of its sides defined by walls disposed at right angles to each other, said tool including a head including a straight conical point and a shank of a diameter substantially less than the cross section of the glazing and of substantial length in relation to the diameter thereof, and a handle to which the shank is secured with said point disposed towards but angled away from said handle to provide an angular relationship that does not exceed 30° between the point and the line of force which is generated when the handle is manually held and pulled lengthwise of the glazing with the point in contact with an end of the glazing and parallel to said sides and close to one of them, the angle of taper and the length and diameter of said point such as to enable radial expanding stresses adequate to rupture the glazing to be developed with a pulling force that can be readily applied and controlled.

2. The tool of claim 1 in which said angular relationship is approximately 24°.

3. The tool of claim 1 in which the angle of taper of the point is in the approximate range of from 1° to 7°.

4. The tool of claim 1 in which the angle of taper is 4° to 6°.

5. The tool of claim 1 in which the diameter of the base of the point is in the approximate range of from 0.025 to 0.250 inches.

6. The tool of claim 1 in which the diameter of the base of the point is in the approximate range of from 0.080 to 0.125 inches.

7. The tool of claim 1 in which the length of the point does not exceed two inches.

8. The tool of claim 1 in which the head includes a shank portion and an end portion disposed at right angles thereto and the handle includes two sections and means to clamp said sections together, at least one of the proximate faces of the clamped-together sections having an L-shaped channel in which the shank and end portions of the head are accommodated and anchored to hold the shank from moving lengthwise or turning relative to the handle, and said tool also includes a pair of plates including end portions which are planing blades of substantial length, means connecting said plates to the outer surfaces of said sections at the same end as said head but with said blades opposite thereto and with said blades abutting to define a right angular cutting edge spaced from the handle and inclined forwardly away from the handle at an angle that does not exceed 30° relative to said line of force and with the blades spaced from the handle.

9. The tool of claim 8 in which the outer surface of each section has a shallow channel adjacent said end, each channel extending diagonally toward said end and away from said point.

10. The tool of claim 1 in which the handle is straight and the tool includes right angular planing blade portions of substantial length connected to the handle at the same end of the handle as said head but opposite said point, the apex of said portions spaced from said handle and inclined inwardly towards said end at an angle that does not exceed 30° relative to the lengthwise center line of the handle, and the end edges of said portions that are disposed towards the other handle end are cutting edges.

11. The tool of claim 10 in which said angle of taper is approximately 20°.

* * * * *